US009341037B2

(12) United States Patent
Suter

(10) Patent No.: US 9,341,037 B2
(45) Date of Patent: May 17, 2016

(54) AUTOCHOKE SYSTEM

(75) Inventor: Roger Suter, Katy, TX (US)

(73) Assignee: M-I L.L.C., Houston, TX (US)

( * ) Notice: Subject to any disclaimer, the term of this patent is extended or adjusted under 35 U.S.C. 154(b) by 477 days.

(21) Appl. No.: 13/148,117

(22) PCT Filed: Feb. 10, 2010

(86) PCT No.: PCT/US2010/023751

§ 371 (c)(1),
(2), (4) Date: Aug. 5, 2011

(87) PCT Pub. No.: WO2010/093691

PCT Pub. Date: Aug. 19, 2010

(65) Prior Publication Data

US 2012/0024531 A1 Feb. 2, 2012

Related U.S. Application Data

(60) Provisional application No. 61/151,664, filed on Feb. 11, 2009.

(51) Int. Cl.
*E21B 21/10* (2006.01)
*E21B 21/08* (2006.01)
(Continued)

(52) U.S. Cl.
CPC ..... *E21B 21/106* (2013.01); *E21B 21/08* (2013.01); *F15B 1/022* (2013.01); *E21B 21/10* (2013.01); *F15B 1/26* (2013.01); *F15B 13/0433* (2013.01); *F15B 20/004* (2013.01); *F15B 2211/20576* (2013.01); *F15B 2211/212* (2013.01); *F15B 2211/575* (2013.01); *F15B 2211/6355* (2013.01); *F15B 2211/8633* (2013.01); *F15B 2211/8752* (2013.01); *F15B 2211/885* (2013.01)

(58) Field of Classification Search
CPC ..... E21B 21/08; E21B 21/106; E21B 21/10
USPC ..... 166/324, 250.15, 373, 374, 319, 332.7, 166/321, 250.07, 250.08, 91.1; 175/25, 38, 175/48; 137/596.18; 251/26, 28; 60/413
See application file for complete search history.

(56) References Cited

U.S. PATENT DOCUMENTS 3,906,726 A * 9/1975 Jameson ..... 60/327
4,257,442 A 3/1981 Claycomb
(Continued)

FOREIGN PATENT DOCUMENTS

EA 003044 12/2002
EP 2396498 B1 5/2015
(Continued)

OTHER PUBLICATIONS

International Search Report issued in PCT/US2010/023751, dated Jun. 29, 2010, 3 pages.
(Continued)

*Primary Examiner* — Jennifer H Gay
*Assistant Examiner* — George Gray

(57) ABSTRACT

Back pressure control devices used to control fluid pressure in a wellbore require various utilities for operation, such as an air supply. With the use of an air supply, the continued operation of one or more back pressure control devices may be achieved when supply of utilities for operation of the back pressure control devices are intentionally or unintentionally interrupted.

9 Claims, 2 Drawing Sheets

(51) Int. Cl.

| | |
|---|---|
| ***F15B 1/02*** | (2006.01) |
| *F15B 1/26* | (2006.01) |
| *F15B 13/043* | (2006.01) |
| *F15B 20/00* | (2006.01) |

(56) References Cited

U.S. PATENT DOCUMENTS

| | | | | |
|---|---|---|---|---|
| 4,355,784 | A | 10/1982 | Cain | |
| 6,253,787 | B1 * | 7/2001 | Suter et al. | 137/509 |
| 6,575,244 | B2 | 6/2003 | Chang et al. | |
| 7,004,448 | B2 | 2/2006 | Suter et al. | |
| 7,478,672 | B2 | 1/2009 | Rogers et al. | |
| 2005/0092523 | A1 * | 5/2005 | McCaskill et al. | 175/38 |
| 2006/0011236 | A1 | 1/2006 | Suter et al. | |
| 2006/0201671 | A1 | 9/2006 | Rogers et al. | |
| 2008/0060846 | A1 | 3/2008 | Belcher et al. | |
| 2009/0159291 | A1 * | 6/2009 | Rodger | 166/355 |
| 2009/0260698 | A1 | 10/2009 | Suter | |

FOREIGN PATENT DOCUMENTS

| | | | |
|---|---|---|---|
| WO | 2007/122430 | A1 | 11/2007 |
| WO | 2008/079992 | A1 | 7/2008 |

OTHER PUBLICATIONS

Written Opinion issued in PCT/US2010/023751, dated Jun. 29, 2010, 3 pages.

Correspondence reporting an Official Action issued Jun. 24, 2013 in corresponding Eurasian application No. 201171038 (4 pages).

Examination Report issued in Canadian Application No. 2749580, dated Mar. 18, 2013, (3 pages).

Correspondence reporting an Official Action issued Feb. 11, 2014 in corresponding Eurasian application No. 201171038 (11 pages).

Extended European Search Report issued Feb. 7, 2014 in corresponding European application No. 10741660.4 (6 pages).

Communication pursuant to Rules 70(2) and 70a(2) EPC issued Feb. 25, 2014 in corresponding European application No. 10741660.4 (1 page).

Office Action issued in AR application 20100100399 on Aug. 26, 2015, 2 pages.

* cited by examiner

AUTOCHOKE SYSTEM

BACKGROUND OF DISCLOSURE

1. Field of the Disclosure

Embodiments disclosed herein relate generally to an apparatus for controlling a back pressure control system. In another aspect, embodiments disclosed herein relate to an apparatus for controlling a plurality of back pressure control systems. In yet another aspect, embodiments disclosed herein relate to an apparatus for controlling pressure of a fluid in a wellbore.

2. Background

There are many applications in which there is a need to control the back pressure of a fluid flowing in a system. For example, in the drilling of oil wells it is customary to suspend a drill pipe in the well bore with a bit on the lower end thereof and, as the bit is rotated, to circulate a drilling fluid, such as a drilling mud, down through the interior of the drill string, out through the bit, and up the annulus of the well bore to the surface. This fluid circulation is maintained for the purpose of removing cuttings from the well bore, for cooling the bit, and for maintaining hydrostatic pressure in the well bore to control formation gases and prevent blowouts, and the like. In those cases where the weight of the drilling mud is not sufficient to contain the bottom hole pressure in the well, it becomes necessary to apply additional back pressure on the drilling mud at the surface to compensate for the lack of hydrostatic head and thereby keep the well under control. Thus, in some instances, a back pressure control device is mounted in the return flow line for the drilling fluid.

Back pressure control devices are also necessary for controlling "kicks" in the system caused by the intrusion of salt water or formation gases into the drilling fluid which may lead to a blowout condition. In these situations, sufficient additional back pressure must be imposed on the drilling fluid such that the formation fluid is contained and the well controlled until heavier fluid or mud can be circulated down the drill string and up the annulus to kill the well. It is also desirable to avoid the creation of excessive back pressures which could cause the drill string to stick, or cause damage to the formation, the well casing, or the well head equipment.

However, maintenance of an optimum back pressure on the drilling fluid is complicated by variations in certain characteristics of the drilling fluid as it passes through the back pressure control device. For example, the density of the fluid can be altered by the introduction of debris or formation gases, and/or the temperature and volume of the fluid entering the control device can change. Therefore, the desired back pressure will not be achieved until appropriate changes have been made in the throttling of the drilling fluid in response to these changed conditions. Conventional devices, such as a choke, generally require manual control of and adjustments to the back pressure control device orifice to maintain the desired back pressure. However, manual control of the throttling device involves a lag time and generally is inexact.

U.S. Pat. No. 4,355,784 discloses an apparatus and method for controlling back pressure of drilling fluid in the above environment which addresses the problems set forth above. According to this arrangement, a substantially balanced shuttle moves in a housing to control the flow and the back pressure of the drilling fluid. One end of the shuttle assembly is exposed to the pressure of the drilling fluid and its other end is exposed to the pressure of a control fluid.

U.S. Pat. No. 6,253,787 discloses a choke device that operates automatically to maintain a predetermined back pressure on the flowing fluid despite changes in fluid conditions. As described therein, to maintain accurate control of the back pressure applied during shuttling, a back pressure may be exerted on the shuttle assembly by a control fluid. The pressure of the fluid in the inlet passage acts on a corresponding end of the shuttle assembly with the same force imposed on the other end of the shuttle assembly by the control fluid.

U.S. Pat. No. 7,004,448 discloses a back pressure control system useful for operating pressures up to about 690 or 1034 bar (10,000 or 15,000 psia). The back pressure control device disclosed therein requires a wellbore pressure greater than the hydraulic set point pressure to open the valve from a fully closed position, as when in the fully closed position, the operating fluid may only act upon a portion of the operating surface area of the shuttle (reference numeral 40 in the '448 patent). However, due to control at relatively high pressures for this system, an overshoot of pressure of up to about 500 psi may be tolerated.

U.S. patent application Ser. No. 12/104,106 (U.S. Patent Application Publication No. 2009/0260698) discloses a back pressure control system useful for operating pressures up to about 103 bar (1500 psia), where a lower pressure overshoot may be required to open the valve. Such a system may be useful in Managed Pressure Drilling environments (MPDs, typically having wellbore pressures of less than 69 bar (1000 psia)).

U.S. Pat. Nos. 6,575,244 and 7,478,672 describe systems for controlling a pressure in a subterranean formation. In the '244 patent, well pressure may be controlled using an automatic choke and advanced controls (e.g., PID control). In the '672 patent, an electronic choke is controlled using a remote and a local operating panel, suitable for use in hazardous environments.

Locations where oil or gas wells are being drilled generally have limited resources available for continuous use, such as utilities including air, electricity, etc. As a result, it is not uncommon, for example, for the air supply or electrical power to a back pressure control system to be temporarily interrupted; such interruptions in back pressure system control can adversely affect drilling operations. Additional challenges exist for low-pressure (<103 bar (<1500 psia) back pressure control systems, where sustained accurate control of the well pressure is essential.

Accordingly, there exists a need for robust systems for controlling the operating pressure within a subterranean borehole

SUMMARY OF THE DISCLOSURE

In one aspect, embodiments disclosed herein relate to an apparatus for controlling a back pressure control system, wherein the back pressure control system includes a housing having an inlet, an outlet, and a pressure chamber; a shuttle assembly adapted to reciprocate in the pressure chamber to regulate the flow of an operating fluid from the inlet to the outlet; the operating fluid applying an opening force to a first end of the shuttle assembly; and a control fluid to apply a closing force to an opposite end of the shuttle assembly. The apparatus may include: an air source for supplying air to the system; an air storage vessel in fluid communication with the air source; a control fluid storage vessel; a pneumatic pump in fluid communication with the control fluid storage vessel, wherein the pneumatic pump is operated via air supplied from the air source; a second pump in fluid communication with the control fluid storage vessel, wherein the second pump is a manual pump or an electric pump; a control fluid pressure control system for controlling a pressure of the control fluid, wherein the control fluid pressure control system comprises:

one or more valves for regulating a flow of control fluid i) from at least one of the pneumatic pump, the second pump, and a control fluid accumulator to the back pressure control system, and ii) from the back pressure control system to the hydraulic fluid reservoir; the control fluid accumulator in fluid communication with the pneumatic pump, the second pump, and the one or more valves for regulating a flow of the control fluid; devices for operating the one or more valves via fluid communication with the air storage vessel; wherein, when the air source supply is interrupted, the control fluid pressure control system can continue controlling the pressure of the control fluid via one or more of: air stored in the air storage vessel fed to the actuators; control fluid accumulated in the control fluid accumulator; and control fluid pressurized via operation of the second pump.

In other aspects, embodiments disclosed herein relate to an apparatus for controlling a back pressure control system, wherein the back pressure control system includes a housing having an inlet, an outlet, and a pressure chamber; a shuttle assembly adapted to reciprocate in the pressure chamber to regulate the flow of an operating fluid from the inlet to the outlet; the operating fluid applying an opening force to a first end of the shuttle assembly; and a control fluid to apply a closing force to an opposite end of the shuttle assembly, the apparatus including: an air source for supplying air to the system; an air storage vessel in fluid communication with the air source; a control fluid storage vessel; a pneumatic pump in fluid communication with the control fluid storage vessel, wherein the pneumatic pump is operated via air supplied from the air source; a second pump in fluid communication with the control fluid storage vessel, wherein the second pump is a manual pump or an electric pump; a control fluid pressure control system for controlling a pressure of the control fluid, wherein the control fluid pressure control system comprises: one or more valves for regulating a flow of control fluid i) from at least one of the pneumatic pump, the second pump, and a control fluid accumulator to the back pressure control system, and ii) from the back pressure control system to the hydraulic fluid reservoir; the control fluid accumulator in fluid communication with the pneumatic pump, the second pump, and the one or more valves for regulating a flow of the control fluid; devices for operating the one or more valves via fluid communication with the air storage vessel; a remote operating panel receiving data from at least one remotely located wellbore sensor, the remote operating panel comprising: a plurality of operator controls located on the housing for controlling operation of the control fluid pressure control system; and a display located on the housing for visually displaying values of data received from the wellbore sensor; a local operating panel in electronic communication with the remote operating panel, the local operating panel comprising: a local operator controller having an operator interface for receiving operator instruction input into the local panel, and operable to receive operator instructions from the remote panel and transmit operator instructions; wherein, when the air source supply is interrupted, the control fluid pressure control system can continue controlling the pressure of the control fluid via one or more of: air stored in the air storage vessel fed to the actuators; control fluid accumulated in the control fluid accumulator; and control fluid pressurized via operation of the second pump.

In other aspects, embodiments disclosed herein relate to an apparatus for controlling a plurality of back pressure control systems, wherein each back pressure control system includes a housing having an inlet, an outlet, and a pressure chamber; a shuttle assembly adapted to reciprocate in the pressure chamber to regulate the flow of an operating fluid from the inlet to the outlet; the operating fluid applying an opening force to a first end of the shuttle assembly; and a control fluid to apply a closing force to an opposite end of the shuttle assembly, the apparatus including: an air source for supplying air to the system; an air storage vessel in fluid communication with the air source; a control fluid storage vessel; a pneumatic pump in fluid communication with the control fluid storage vessel, wherein the pneumatic pump is operated via air supplied from the air source; a second pump in fluid communication with the control fluid storage vessel, wherein the second pump is a manual pump or an electric pump; a control fluid accumulator in fluid communication with the pneumatic pump, the second pump, and one or more control fluid pressure control systems for regulating a flow of the control fluid to the one or more back pressure control system; the plurality of control fluid pressure control system for controlling a pressure of the control fluid to the plurality of back pressure control systems, wherein each control fluid pressure control system comprises: one or more valves for regulating a flow of control fluid i) from at least one of the pneumatic pump, the second pump, and the control fluid accumulator to the back pressure control system, and ii) from the back pressure control system to the hydraulic fluid reservoir; devices for operating the one or more valves via fluid communication with the air storage vessel; wherein, when the air source supply is interrupted, the control fluid pressure control system can continue controlling the pressure of the control fluid via one or more of: air stored in the air storage tank fed to the actuators; control fluid accumulated in the control fluid accumulator; and control fluid pressurized via operation of the second pump.

Other aspects and advantages will be apparent from the following description and the appended claims.

DETAILED DESCRIPTION

In one aspect, embodiments disclosed herein relate to an apparatus for controlling a back pressure control system. In another aspect, embodiments disclosed herein relate to an apparatus for controlling a plurality of back pressure control systems. In yet another aspect, embodiments disclosed herein relate to an apparatus for controlling pressure of a fluid in a wellbore. In some embodiments, apparatus disclosed herein meet the requirements of Class 1, Division 1 standards as established by the American Petroleum Institute (API) and published in the API "Recommended Practice for Classification of Locations for Electrical Installations at Petroleum Facilities," API Recommended Practice 500 (RP500), First Edition, Jun. 1, 1991, specifically incorporated herein by this reference.

Back pressure control systems useful in embodiments disclosed herein may include those described in, for example, U.S. Pat. Nos. 7,004,448 and 6,253,787, U.S. Patent Application Publication No. 20060011236, and U.S. Patent Application Publication No. 2009/0260698 (assigned to the assignee of the present application), each of which is incorporated herein by reference.

Figure 1:
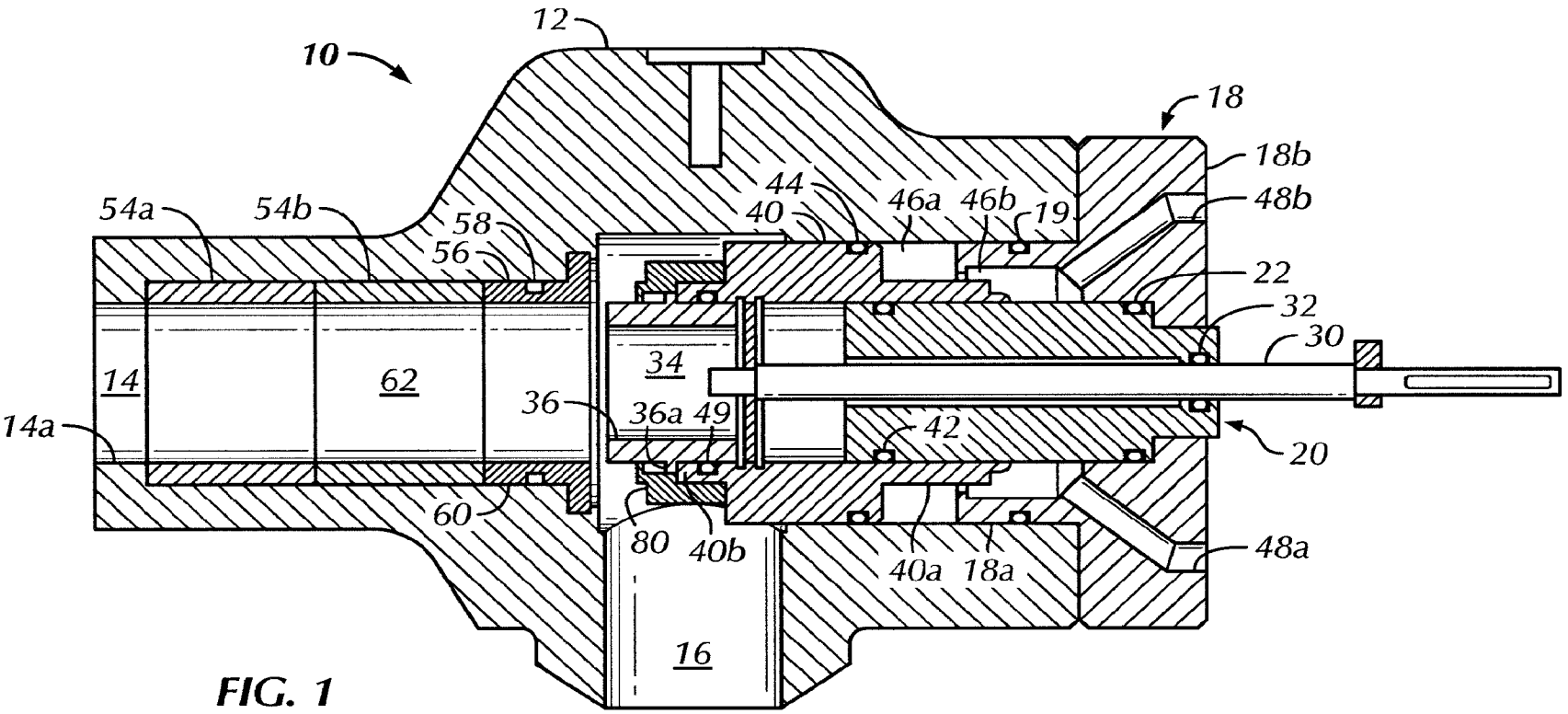
FIG. 1 (Prior Art)
FIG. 1 is a schematic diagram of back pressure control systems useful in embodiments disclosed herein.
Figure 2:
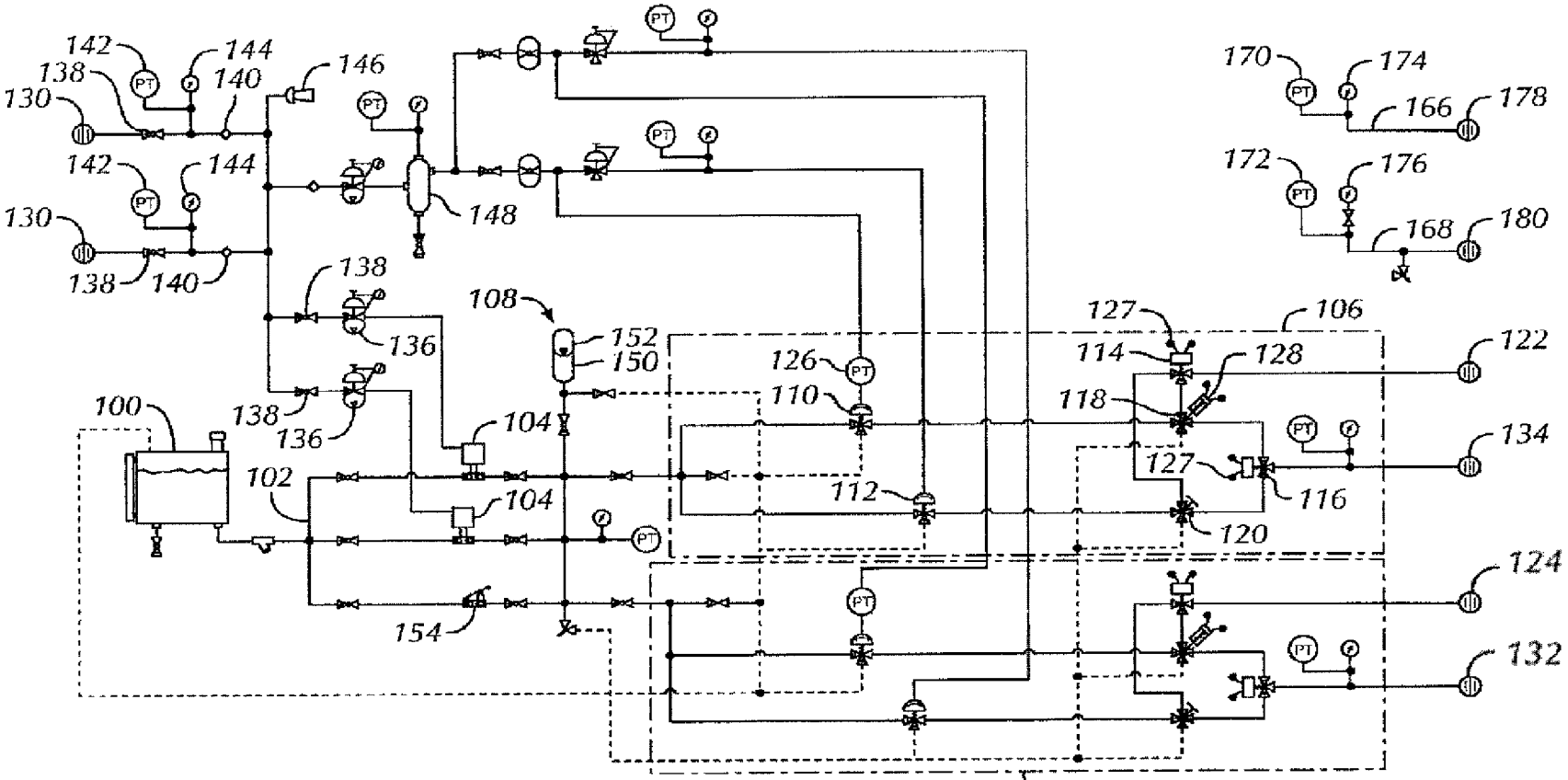
FIG. 2 is a simplified flow diagram of a system according to embodiments disclosed herein for controlling a pressure of a control fluid to a back pressure control system such as illustrated in FIG. 1.

Referring now to FIG. 1, a back pressure control system 10 according to embodiments disclosed herein is illustrated, similar to that of FIG. 2 in U.S. Patent Application Publication No. 2009/0260698. The fluid control system 10 includes a housing 12 having an axial bore 14 extending through its length and having a discharge end 14*a*. A radially extending inlet passage 16 is also formed in the housing 12 and intersects the bore 14. Connecting flanges (not shown) can be provided at the discharge end 14*a* of the bore 14 and at the inlet end of the passage 16 to connect them to appropriate flow lines. Drilling or formation fluid from a well is introduced into the inlet passage 16, passes through the housing 12 and normally discharges from the discharge end of the bore 14.

A bonnet 18 is secured to the end of the housing 12 opposite the discharge end 14*a* of the bore 14. The bonnet 18 is substantially T-shaped in cross section and has a cylindrical portion 18*a* extending into the bore 14 of the housing. A seal ring 19 extends in a groove formed in an outer surface of the bonnet portion 18*a* and engages a corresponding inner surface of the housing 12. The bonnet 18 also includes a cross portion 18*b* that extends perpendicular to the cylindrical portion 18*a* and is fastened to the corresponding end of the housing 12 in any conventional manner.

A mandrel 20 is secured in the end portion of the bonnet 18, and a seal ring 22 extends between the outer surface of the mandrel and the corresponding inner surface of the bonnet. A rod 30 is slidably mounted in an axial bore extending through the mandrel 20, and a seal ring 32 extends in a groove formed in the inner surface of the mandrel defining the latter bore. The seal ring 32 engages the outer surface of the rod 30 as the rod slides in the bore of the mandrel 20 under conditions to be described. One end portion of the rod 30 projects from the corresponding ends of the mandrel 20 and the bonnet 18, and the other end portion of the rod 30 projects from the other end of the mandrel 20 and into the bore 14.

In some embodiments, a spacer 34 is mounted on the latter end of the rod 30 in any known manner and is captured between two snap rings (not shown). A cylindrical choke member 36 is disposed in the bore 14 with one end abutting the spacer 34. The choke member 36 is shown in an operating position in FIG. 1 and extends in the intersection of the bore 14 with the inlet passage 16 to control the flow of fluid from the latter to the former, as will be described.

A cylindrical shuttle 40 is slidably mounted over the mandrel 20, and a seal ring 42 extends in a groove formed in an outer surface of the mandrel 20 and engages a corresponding inner surface of the shuttle 40. Similarly, a seal ring 44 extends in a groove formed in an outer surface of the shuttle 40 and engages a corresponding inner surface of the housing 12. The shuttle 40 has a reduced-diameter portion 40*a* that defines, with the inner surface of the housing 12, a fluid chamber 46*a*. Another fluid chamber 46*b* is defined between the outer surface of the mandrel 20 and the corresponding inner surface of the bonnet portion 18*a*. The chambers 46*a* and 46*b* communicate and receive a control fluid from a passage 48*a* formed through the bonnet 18. It is understood that the passage 48*a* is connected to an apparatus according to embodiments disclosed herein, such as illustrated in FIG. 2, for circulating the control fluid into and from the passage 48*a*. In this context, the control fluid is introduced into the passage 48*a*, and therefore into the chambers 46*a* and 46*b*, at a predetermined, desired set point pressure, such as determined by a set point pressure regulator (not shown) and measured by a gage located on an associated console or control panel (not shown).

The control fluid enters the chambers 46*a* and 46*b* and acts against the corresponding exposed end portions of the shuttle 40. The shuttle 40 is designed to move, so the force caused by the pressure of the control fluid from the chambers 46*a* and 46*b* at the predetermined set point pressure acting on the corresponding exposed end portions of the shuttle 40 is equal to the force caused by the pressure of the drilling or formation fluid in the passage 16 acting on the corresponding exposed end portions of the other end of the shuttle 40 and the shuttle nut 80. Thus, the shuttle 40 is normally in a balanced condition as will be described. A passage 48*b* is also formed through the bonnet portion 18 for bleeding air from the system through a bleed valve, or the like (not shown) before operation.

The shuttle 40 has an externally threaded, reduced-diameter, end portion 40*b* which extends over a portion of the choke member 36. A seal ring 49 extends in a groove formed in an inner surface of the end portion 40*b* and engages a corresponding outer surface of the choke member 36. An internally threaded shuttle nut 80 threadedly engages the end portion 40*b* of the shuttle 40 and extends over an annular flange 36*a* formed on the choke member 36, to capture the choke member on the shuttle 40. The shuttle 40, in some embodiments, also has two spaced grooves formed in its inner diameter for receiving the snap rings. Therefore, axial movement of the shuttle 40 over the fixed mandrel 20 causes corresponding axial movement of the choke member 36, and therefore the spacer 34 and the rod 30.

Two or more cylindrical liners 54*a* and 54*b* are provided in the bore 14 downstream of its intersection with the passage 16. A choke seat 56 is also disposed in the bore upstream from the liner 54*b*, and a seal ring 58 extends in a groove formed in the outer surface of the choke seat and engages a corresponding portion of the inner surface of the housing 12. The choke seat 56 and, therefore, the liners 54*a* and 54*b* are retained in the bore 14 by a static trim member 60. The liners 54*a* and 54*b* and the choke seat 56 define a discharge passage 62 in the bore 14 of the housing 12 extending from the intersection of the bore 14 and the passage 16 to the discharge end 14*a* of the bore 14. The internal diameter of the choke seat 56 is sized relative to the outer diameter of the choke member 36 to receive same. Manufacture of specific components of the back pressure control systems useful with apparatus according to embodiments disclosed herein may vary from that described in relation to FIG. 1.

Control fluid pressure, used to regulate the operating pressure of a back pressure control system, such as illustrated in FIG. 1, may be regulated and controlled via apparatus disclosed herein. Referring now to FIG. 2, a simplified schematic of an apparatus for controlling the operating pressure of a back pressure control system, such as described above with regard to FIG. 1, is illustrated. Although illustrated and described as including various components, one skilled in the art recognizes that additional components, such as valves, check valves, pressure gages and transmitters, temperature gages and transmitters, filters, strainers, and other piping and control equipment may also be included without deviating from the scope of embodiments disclosed herein.

Control fluid used for pressurizing chambers 46*a*, 46*b* may be stored in a control fluid storage vessel 100. The control fluid may be fed via flow line 102 to a pneumatic pump 104 for pressurizing and supplying control fluid to a control fluid pressure control system 106 used to control the pressure of the control fluid in chambers 46*a*, 46*b*. If desired, two or more pneumatic pumps 104 may be placed in parallel, allowing for maintenance of the system.

Pressure control system may include a control fluid accumulator 108, such as a gas-charged piston-type or bladder-type accumulator, and one or more flow control devices, such as one or more pressure regulators 110, 112 and one or more control valves 114, 116, 118, 120, for controlling the feed of control fluid pressure to flow conduits 122, 124, which may be fluidly connected to passage 48*a* (FIG. 1), for instance. Pressure regulators 110, 112 and control valves 114, 116, 118, 120 may include multiple inlets and/or outlets for transmitting control fluid to and from control fluid storage tank 100 (control fluid return lines are shown as dotted lines).

The position or setting of the one or more flow control devices (110, 112, 114, 116, 118, 120) may be controlled using pneumatic operators, such as air operated actuators with current-to-pressure transducers (I/P transducers) for receiving a signal from a digital control system (DCS) (not shown) or a control panel (as described below), solenoid actuated valves, and the like. For example, as illustrated in FIG. 2, pressure regulator 110 may be operated using I/P transducer 126. As another example, as illustrated in FIG. 2, valves 114, 116 may be 3-way solenoid operated valves having wire terminals 127 for communicating with the control panel or a DCS; valve 118 may be a 4-way selector valve with a pneumatic operator 128. Valve 120 may be a remotely operated valve or a manually operated valve, such as a 4-way selector valve.

Flow control devices 110, 112, 114, 116, 118, 120 may be used to regulate flow to and from channel 48*a*. In some embodiments, flow line 122 and the associated flow control devices may provide for relief of pressure from chambers 46*a*, 46*b* (i.e., flow of fluid from channel 48*a*, such that the back pressure control system is in the fully open position. Flow line 124 and the associated flow control devices may provide for regulated flow of control fluid to and from channel 48*a* (i.e., for controlling the pressure of the control fluid in chambers 46*a*, 46*b*).

Flow lines and connections 166, 168, pressure transmitters 170, 172, and pressure gages 174, 176 may also be provided to monitor the pressure in the casing 178 or the drill pipe 180. Monitoring of such pressures may be useful in determining operational performance of the back-pressure control system, and for establishing control fluid pressure set points, among others.

To operate the pneumatic pumps, actuators, and pneumatic operated valves, an air source 130 may be fluidly connected to the apparatus for controlling a back-pressure control system according to embodiments disclosed herein, such as via flow lines 132, 134. The air supplied to the system may be utilized in at least two areas, including i) pneumatic pump 104 operations, and ii) flow control device operations, such as for operation of one or more of flow control devices 110, 112, 114, 116, 118, and 120.

The air supply to i) the pneumatic pumps 104 may be filtered, if necessary, and regulated to the desired pneumatic pump inlet pressure. In some embodiments, a filter regulator 136 may be used to both filter and regulate the air supplied to pneumatic pumps 104. Isolation valves 138, check valves 140, pressure transmitters 142, and pressure gages 144, among other equipment, may also be used, as necessary or desired. Additionally, if desired, horn 146 may be used to signal when the air supply is de-activated.

The air supply to ii) flow control device operations may initially supply air to an air storage vessel 148, such as a one to twenty gallon pressurized vessel. One or more outlets from air storage vessel 148 may then be used to feed the air to the respective actuators, I/P transducers, pneumatic operators, etc. to operate one or more of the flow control devices 110, 112, 114, 116, 118, 120. Isolation valves 138, check valves 140, pressure transmitters 142, and pressure gages 144, among other equipment, may also be used to control and monitor the operation of the control fluid pressure control system 106.

As mentioned previously, it is not uncommon for utilities to be diverted, intentionally or unintentionally, during drilling operations. Apparatus according to embodiments disclosed herein may continue operations for extended periods of time in such instances. For example, during normal operation, pneumatic pumps 104 may provide control fluid to the system, where loss of air supply would result in the stoppage of pneumatic pumps 104. Control fluid accumulator 108, which includes a control fluid storage chamber 150 and a pressurized chamber 152, may provide for supply and pressurization of the control fluid when pneumatic pumps 104 are purposefully (such as during maintenance) or inadvertently shut down. Additionally, a manually operated pump 154 or an electric pump (if allowed in the operating environment) may be used to provide for additional supply and pressurization of the control fluid.

Loss of air supply additionally means loss of a continuous supply of air to flow control devices 110, 112, 114, 116, 118, 120. Air stored within air storage vessel 148 may be used to temporarily supply air to the flow control devices. For example, air storage vessel 148 may be operated at a pressure similar to the air supply pressure, where loss of the air supply would result in a slow decrease in air pressure within air storage vessel 148 over time due to valve operation. Apparatus according to embodiments disclosed herein may provide for the continued operation and control of back-pressure flow control devices for up to 1, 2, 3, 4, or 5 hours or more.

The length of time that operations may be sustained, when air supply is interrupted, using apparatus according to embodiments disclosed herein may depend on a number of variables, including the size and operating pressure of air storage vessel 148, the size and operating (piston/bladder) pressure of control fluid accumulator 108, intermittent or continuous operation of manual pump 154, and the amount of flow control device activity (i.e., valve manipulation) during the interruption.

While air storage vessel 148 may additionally be used to operate pneumatic pumps 104, such a configuration may be undesirable due to the amount of air required for continued operation of the pumps. As illustrated in FIG. 2, air storage vessel 148 is isolated from pneumatic pumps 104, thus avoiding the potentially fast use of stored air during an air supply interruption.

The components described above may be used to operate a single back-pressure control system. Apparatus according to embodiments disclosed herein may also be used to operate a plurality of back-pressure control systems. As illustrated, the system is for control of two back pressure control systems, however the system may logically be extended to three or more back pressure control systems. For example, one or more control fluid pressure control systems 160, similar to control fluid pressure control system 106 described above, may be provided to operate additional back pressure control systems. Control fluid and air may be supplied to the one or more control fluid pressure control systems 160 from fluid conduit headers connected to air supply 130, air storage vessel 148, and pumps 104, 154.

In some embodiments, it may be desired to have the ability to control the back pressure control systems locally, proximate the location of the back pressure control system, or remotely. Apparatus according to embodiments disclosed herein, such as described with regard to FIG. 2, may be associated with operating panels, similar to those described in U.S. Patent Application No. 2006/0201671, which is incorporated herein by reference, including a remote operating panel and a local operating panel, which may be located within 30 feet from the back-pressure control system. The remote operating panel, for example, may receive data from at least one remotely located wellbore sensor. The remote operating panel may include: a plurality of operator controls located on the housing for controlling operation of the back pressure control system; and a display located on the housing for visually displaying values of data received from the wellbore sensor. The local operating panel may be in electronic communication with the remote operating panel. The local operating panel may include: a local operator controller having an operator interface for receiving operator instruction input into the local panel, and operable to receive operator instructions from the remote panel and transmit operator instructions.

In some embodiments, such as to meet classifications for hazardous environments, the above described remote and local operating panels may include a housing within which the controls are located, including one or more of speed dials, open/close levers, a contrast, a stroke reset switch, analog gauges, a digital display, and other components useful for operation of the pressure control apparatus described in relation to FIG. 2. The operating panels may also include a plurality of electronic inputs to provide input of electronic data from one or more sensor communication cables and/or one or more sensors. A panel communication cable may connect the local panel to the remote panel electronically.

If necessary, an air purge system may be used to ensure that the local and/or remote panels are safe for operation in an area that is classified as hazardous. A common or separate air source may provide air to the air purge system. In one embodiment, the air source for the air purge system is from the rig. In another embodiment, the air source is a separate air source dedicated to the local and/or remote panels. The air purge system is in fluid communication with the housing of the panels, which may be airtight. The purge system may include feed lines and intake lines to communicate air into and out of the housing. The clean air provided to the panels prevents any hazardous gases from entering the housing.

One or more sensors are generally located within the wellbore to measure predetermined parameters. In one embodiment, sensor communication cables connect the sensors and the local panel. In one embodiment, the remote actuator panel includes preprogrammed algorithms operative to interpret measurement data and transmit responsive instruction to control fluid pressure control systems 106, 160. In one embodiment, wherein the local panel includes an emergency stop button, instructions from the remote actuator panel are routed through the local panel because the emergency stop cannot be bypassed. In one embodiment, the local panel includes preprogrammed algorithms operative to interpret measurement data and transmit responsive instruction to control fluid pressure control systems 106, 160.

The apparatus described herein provide the operator with three methods of control. The first method is electronically through the use of the remote panel from a remote location such as the doghouse. The second method allows the operator to control the back pressure control system from the local panel. The final method of control is by using manual controls coupled to the control fluid pressure control system. All of the electronic components may be housed in air tight housings within which continual air purge is provided. Thus, the apparatus described herein may be safe for use in a hazardous area pursuant to Class 1 Division 1 standards.

In some embodiments, a remote panel may be in electronic communication with a plurality of local panels located respectively proximate a plurality of back pressure control systems. In some embodiments, the remote panel may include a selection switch on the panel to toggle operational control between two or more detent locations corresponding to the two or more control fluid pressure control systems 106, 160. In other embodiments, the panels may be designed for concurrent control of two or more back pressure control systems without the need for a toggle switch.

In some embodiments, apparatus for controlling back pressure control systems described herein may additionally provide for advanced control of the system components, such as via a proportional-integral-differential (PID) controller, such as described in, for example, U.S. Pat. No. 6,575,244, which is incorporated herein by reference.

Advantageously, embodiments disclosed herein may provide for continued operation of back pressure control systems during intended or unintended interruption of utilities. Control fluid accumulators and air storage vessels may provide for the ability to operate control fluid pressure control systems, and thus continue operation of back pressure control systems, without external sources of air and/or pressurized control fluid. The ability to continue operation of back pressure control systems during utility outages may provide for improved operations during drilling of a wellbore, thus avoiding unwanted pressure deviations and other events that may result in stoppage of drilling or damage to the wellbore and associated equipment.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. An apparatus for controlling a back pressure control system, wherein the back pressure control system includes a housing having an inlet, an outlet, and a pressure chamber; a shuttle assembly adapted to reciprocate in the pressure chamber to regulate the flow of an operating fluid from the inlet to the outlet; the operating fluid applying an opening force to a first end of the shuttle assembly; and a control fluid to apply a closing force to an opposite end of the shuttle assembly, the apparatus comprising:

an air source;

a pneumatic pump in fluid communication with a control fluid storage vessel, wherein the pneumatic pump is operated via air supplied from the air source;

an air storage vessel in fluid communication with the air source, wherein the air storage vessel is fluidly isolated from the pneumatic pump;

a control fluid pressure control system, wherein the control fluid pressure control system comprises:

one or more valves configured to regulate a flow of control fluid: i) from at least one of the pneumatic pump and a control fluid accumulator to the back pressure control system, and ii) from the back pressure control system to the control fluid storage vessel;

the control fluid accumulator in fluid communication with the pneumatic pump and the one or more valves, the control fluid accumulator configured to maintain a supply of pressurized control fluid;

flow control devices in fluid communication with the air storage vessel, wherein the flow control devices operate the one or more valves;

wherein, when the air source supply is interrupted, the control fluid pressure control system continues controlling the pressure of the control fluid via air stored in the air storage vessel and via control fluid accumulated in the control fluid accumulator.

2. The apparatus of claim 1, further comprising a second pump in fluid communication with the control fluid storage vessel, and wherein the control fluid pressure control system comprises:

the one or more valves configured to regulate a flow of control fluid: i) from at least one of the pneumatic pump, the second pump, and a control fluid accumulator to the back pressure control system, and ii) from the back pressure control system to the control fluid storage vessel;

the control fluid accumulator in fluid communication with the pneumatic pump, the second pump, and the one or more valves; and wherein, when the air source supply is interrupted, the control fluid pressure control system can continue controlling the pressure of the control fluid via one or more of:

air stored in the air storage vessel;

control fluid accumulated in the control fluid accumulator; and control fluid pressurized via operation of the second pump.

3. The apparatus of claim 2, wherein the second pump is a manual pump or an electric pump.

4. An apparatus for controlling a back pressure control system, the apparatus comprising:

an air source;

a pneumatic pump in fluid communication with a control fluid storage vessel, wherein the pneumatic pump is operated via air supplied from the air source;

an air storage vessel in fluid communication with the air source, wherein the air storage vessel is fluidly isolated from the pneumatic pump;

a control fluid pressure control system, wherein the control fluid pressure control system comprises:

a pressurized control fluid accumulator in fluid communication with the pneumatic pump and one or more valves, the pressurized control fluid accumulator providing a source of pressurized control fluid; and flow control devices in fluid communication with the air storage vessel;

wherein, when the air source supply is interrupted, the control fluid pressure control system continues controlling the pressure of the control fluid via air stored in the air storage vessel and via pressurized control fluid accumulated in the pressurized control fluid accumulator.

5. The apparatus of claim 4, wherein the back pressure control system further comprises a housing having an inlet, an outlet, and a pressure chamber; a shuttle assembly adapted to reciprocate in the pressure chamber to regulate the flow of an operating fluid from the inlet to the outlet; the operating fluid applying an opening force to a first end of the shuttle assembly; and a control fluid to apply a closing force to an opposite end of the shuttle assembly.

6. The apparatus of claim 4, wherein the one or more valves are configured to regulate a flow of control fluid: i) from at least one of the pneumatic pump and a control fluid accumulator to the back pressure control system, and ii) from the back pressure control system to the control fluid storage vessel.

7. The apparatus of claim 4, further comprising:

a remote operating panel receiving data from at least one remotely located wellbore sensor, the remote operating panel comprising:

a plurality of operator controls located on the housing; and a display located on the housing; and a local operating panel in electronic communication with the remote operating panel, the local operating panel comprising:

a local operator controller having an operator interface.

8. An apparatus for controlling a plurality of back pressure control systems, wherein each back pressure control system includes a housing having an inlet, an outlet, and a pressure chamber; a shuttle assembly adapted to reciprocate in the pressure chamber to regulate the flow of an operating fluid from the inlet to the outlet; the operating fluid applying an opening force to a first end of the shuttle assembly; and a control fluid to apply a closing force to an opposite end of the shuttle assembly, the apparatus comprising:

an air source;

a pneumatic pump in fluid communication with a control fluid storage vessel, wherein the pneumatic pump is operated via air supplied from the air source;

an air storage vessel in fluid communication with the air source, wherein the air storage vessel is fluidly isolated from the pneumatic pump;

a control fluid accumulator in fluid communication with the pneumatic pump, and one or more control fluid pressure control systems, wherein the control fluid accumulator comprises a pressurized chamber and a control fluid storage chamber for supplying pressurized control fluid;

a plurality of control fluid pressure control system, wherein each control fluid pressure control system comprises:

one or more valves configured to regulate a flow of control fluid: i) from at least one of the pneumatic pump and the control fluid accumulator to the back pressure control system, and ii) from the back pressure control system to the control fluid storage vessel;

flow control devices in fluid communication with the air storage vessel, wherein the flow control devices operate the one or more valves;

wherein, when the air source supply is interrupted, the control fluid pressure control system continues controlling the pressure of the control fluid via air stored in the air storage vessel and via control fluid accumulated in the control fluid accumulator.

9. The apparatus of claim 8, further comprising a second pump in fluid communication with the control fluid storage vessel.

* * * * *